US011509989B2

(12) United States Patent
Kim

(10) Patent No.: US 11,509,989 B2
(45) Date of Patent: Nov. 22, 2022

(54) EARBUDS WITH DETACHABLE HARNESS STRAP

(71) Applicant: Plantronics, Inc., Santa Cruz, CA (US)

(72) Inventor: David Kim, Santa Cruz, CA (US)

(73) Assignee: Plantronics, Inc., Santa Cruz, CA (US)

( * ) Notice: Subject to any disclaimer, the term of this patent is extended or adjusted under 35 U.S.C. 154(b) by 0 days.

(21) Appl. No.: 16/988,451

(22) Filed: Aug. 7, 2020

(65) Prior Publication Data

US 2020/0374614 A1 Nov. 26, 2020

Related U.S. Application Data

(63) Continuation of application No. 16/230,875, filed on Dec. 21, 2018, now Pat. No. 10,750,271.

(51) Int. Cl.
*H04R 1/10* (2006.01)
*H04R 5/033* (2006.01)

(52) U.S. Cl.
CPC ..... *H04R 1/105* (2013.01); *H04R 1/1008* (2013.01); *H04R 1/1016* (2013.01); *H04R 1/1033* (2013.01); *H04R 1/1066* (2013.01); *H04R 5/033* (2013.01); *H04R 1/1041* (2013.01); *H04R 2225/31* (2013.01); *H04R 2420/07* (2013.01); *H04R 2499/11* (2013.01)

(58) Field of Classification Search
CPC .. H04R 1/1008; H04R 1/1016; H04R 1/1025; H04R 1/1033; H04R 1/1041; H04R 1/105; H04R 1/1066; H04R 1/1075; H04R 2225/31; H04R 2420/07; H04R 5/033; H04R 2499/11; H04R 25/602
See application file for complete search history.

(56) References Cited

U.S. PATENT DOCUMENTS 3,354,271 A * 11/1967 McDermaid ..... H04R 25/602 381/323
4,379,988 A 4/1983 Mattatall
4,420,657 A 12/1983 Larkin
4,447,677 A * 5/1984 Miyahra ..... H04R 25/456
5,450,496 A 9/1995 Burris et al.
5,610,494 A * 3/1997 Grosfilley ..... H04R 25/602 320/113
6,154,539 A * 11/2000 Pitel ..... H04M 1/05 379/430
6,310,960 B1 10/2001 Saaski et al.
7,062,057 B2 * 6/2006 Wu ..... H02J 7/0045 381/323
7,436,974 B2 10/2008 Harper
7,664,287 B2 * 2/2010 Neu ..... H04R 3/00 381/381
8,712,087 B2 * 4/2014 Ozawa ..... H04R 1/345 381/380
8,761,430 B2 6/2014 Zimmerman
8,891,798 B1 11/2014 Laffon de Mazieres et al.
10,750,271 B1 * 8/2020 Kim ..... H04R 1/1025
2015/0086059 A1 3/2015 Gougherty et al.
(Continued)

*Primary Examiner* — Huyen D Le

(74) *Attorney, Agent, or Firm* — Ferguson Braswell Fraser Kubasta PC

(57) ABSTRACT

Headphones include an earbud, including a knob-shaped body, an earbud tip extending from the knob-shaped body and configured to enter an ear canal of a listener, a harness strap interface disposed on the knob-shaped body and configured to removably accommodate a detachable harness strap.

10 Claims, 7 Drawing Sheets

(56) References Cited

U.S. PATENT DOCUMENTS

| | | | | |
|---|---|---|---|---|
| 2016/0007110 | A1* | 1/2016 | Silvestri | H04R 1/105 |
| 2017/0171656 | A1* | 6/2017 | Toelle | H04R 1/1066 |
| 2017/0289666 | A1* | 10/2017 | Pejaudier | H04R 1/1016 |
| 2018/0077481 | A1 | 3/2018 | Kim | |
| 2018/0084329 | A1 | 3/2018 | Shadowens et al. | |
| 2018/0115839 | A1* | 4/2018 | Eichfeld | H04R 25/453 |

* cited by examiner

EARBUDS WITH DETACHABLE HARNESS STRAP

CROSS-REFERENCE TO RELATED APPLICATIONS

This application is a continuation of U.S. patent application Ser. No. 16/230,875, filed Dec. 21, 2018 and titled "Ear buds with Detachable Harness Strap," which is herein incorporated by reference as though set forth in full.

BACKGROUND

More recent generations of earbud-style headphones are available with wireless interfaces, and therefore do not require a cord connecting the earbuds. While the elimination of the cord may enable new applications and may increase wearing comfort, the risk of losing the earbuds while wearing, transporting or storing the earbuds may also increase.

SUMMARY

In general, in one aspect, one or more embodiments relate to headphones including an earbud. The earbud includes a knob-shaped body, an earbud tip extending from the knob-shaped body and configured to enter an ear canal of a listener, a harness strap interface disposed on the knob-shaped body and configured to removably accommodate a detachable harness strap.

In general, in one aspect, one or more embodiments relate to headphones including two earbuds. Each of the two earbuds include a knob-shaped body and a harness strap interface disposed on the knob-shaped body, and a detachable harness strap configured to removably attach at the harness strap interface of each of the two earbuds.

In general, in one aspect, one or more embodiments relate to a harness strap for earbud-style headphones. The harness strap includes a first retainer loop that is substantially circular and configured to be seated in a groove of a first earbud, a second retainer loop that is substantially circular and configured to be seated in a groove of a second earbud, and a harness strap body configured to connect the first retainer loop to the second retainer loop.

Other aspects of the disclosure will be apparent from the following description and the appended claims.

DETAILED DESCRIPTION

Figure 1:
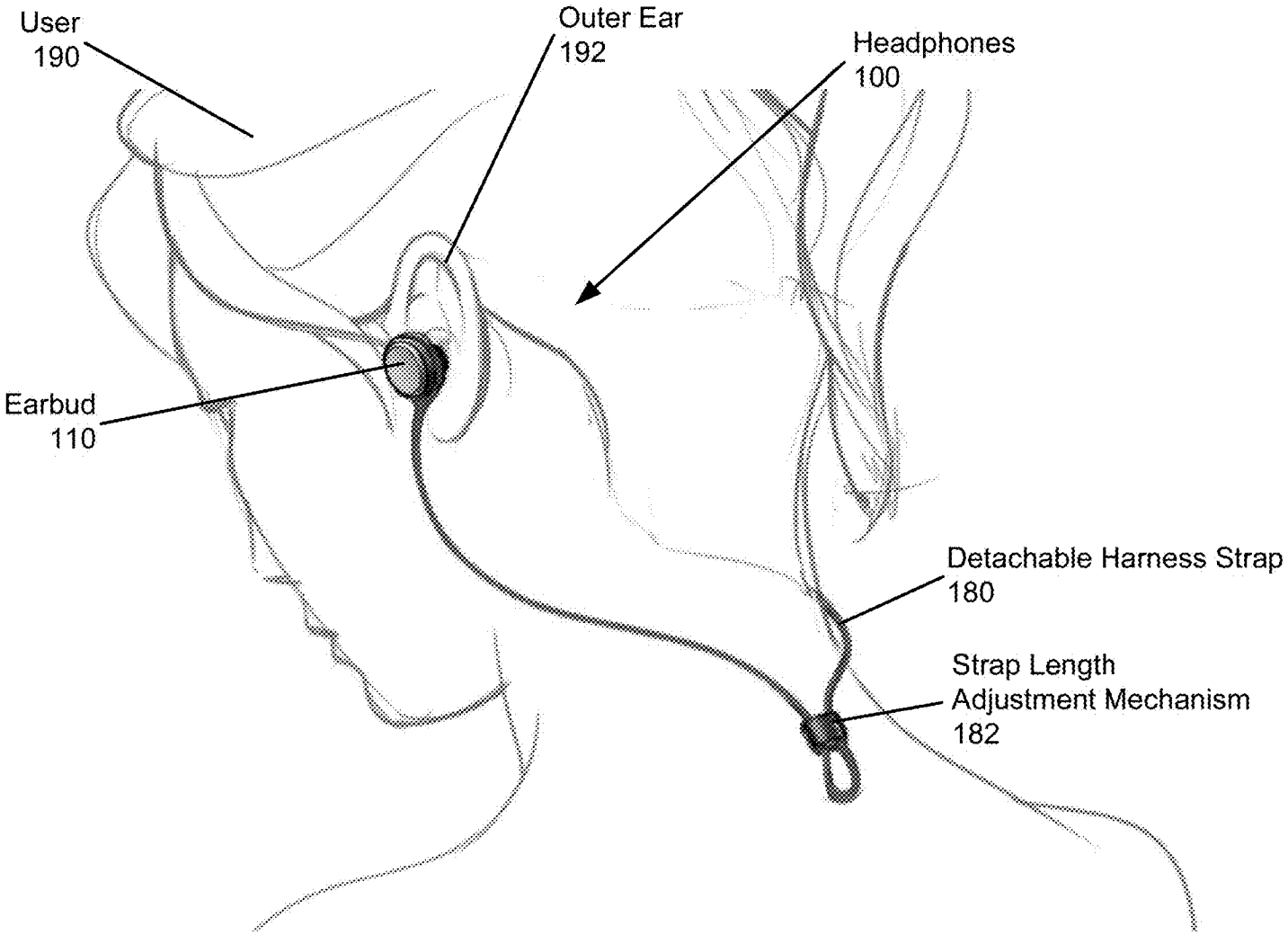
FIG. 1 shows headphones in accordance with one or more embodiments.

Specific embodiments will now be described in detail with reference to the accompanying figures. Like elements in the various figures are denoted by like reference numerals for consistency.

In the following detailed description of embodiments, numerous specific details are set forth in order to provide a more thorough understanding. However, it will be apparent to one of ordinary skill in the art that the invention may be practiced without these specific details. In other instances, well-known features have not been described in detail to avoid unnecessarily complicating the description.

Throughout the application, ordinal numbers (e.g., first, second, third, etc.)

may be used as an adjective for an element (i.e., any noun in the application). The use of ordinal numbers is not to imply or create any particular ordering of the elements nor to limit any element to being only a single element unless expressly disclosed, such as by the use of the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Further, although the description includes a discussion of various embodiments, the various disclosed embodiments may be combined in virtually any manner. All combinations are contemplated herein.

Earbuds-style headphones are a popular choice for listening to music, making phone calls, and other audio applications. Earbuds may provide a high-quality audio signal, may be comfortable to wear, and may be compact and easy to store. Increasingly, earbud-style headphones are available with wireless interfaces such as Bluetooth. The earbuds, therefore, do not use a cord to connect to an audio source. While the use of two separate earbuds with no mechanical link may have advantages, the risk of losing one or both earbuds while wearing, transporting or storing them may increase.

One or more embodiments are directed to an earbud and detachable harness design. In particular, the earbud includes a detachable harness interface located at a knob-shaped body of the earbud. A detachable harness may be connected to the earbud. The harness is detachable in that during standard use, a user may repetitively detach and reattach the earbud without damaging the earbuds or detachable harness strap.

FIG. 1 shows headphones (100) in accordance with one or more embodiments, including earbuds (110) and a detachable harness strap (180). The headphones (100) may be worn by a listener (190). An earbud (110) may attach to a structure of the outer ear (192). For example, the earbud (110) may be partially inserted into the ear canal. Unlike in conventional on-ear headphones, a mechanical brace connecting the left and the right earbud is not used to hold the earbuds in place.

The earbud has a knob-shaped body. The knob-shaped body (212) may be formed by a compact volume, characterized by a width and a length that are approximately equal (e.g., within 70% percent of each other). The width and length are parallel to the listener's ear when worn. The height of the knob shaped body is perpendicular to the listener's ear when worn and may be approximately equal to or less than the width and height. In other words, the body could be described a bulbous rather than elongated. The knob-shaped is symmetrical along at least two axes. The knob-shape does not, however, impose a particular surface geometry. For example, the knob-shaped body may be substantially spherical, cylindrical, cubic, pyramidal, etc., without departing from the invention. In one or more embodiments, the earbud does not include an elongated member extending from the earbud. Different geometries are illustrated in FIGS. 2A, 2B, 2C, 3, 4A, 4B, 5, 6A and 6B.

In one or more embodiments, the earbud includes a harness strap interface disposed on the knob-shaped body and configured to removably accommodate a detachable harness strap. The harness strap interface is configured to hold the detachable harness strap in place when the detachable harness strap is connected without user assistance and release the detachable harness strap with some applied force. For example, the detachable harness strap interface may be a mechanical interface, a magnetic interface, or a combination thereof.

As illustrated in FIG. 1, a detachable harness strap (180) may link the earbuds (110), in accordance with one or more embodiments. The harness strap (180) provides a user of the earbuds with wearing options that would otherwise not be available. For example, the earbuds may be carried around the neck using the harness strap (180). This may be particularly beneficial when temporarily doffing the earbuds, for example, during a conversation. The listener (190) may choose to attach or detach the earbuds (110) from the detachable harness strap (180) at any time, while the headphones (100) are worn, transported, or stored. When used in conjunction with the harness strap (180), the risk of losing the earbuds (182) may be significantly reduced. For additional wearing comfort, the harness strap (180) may include a strap length adjustment mechanism (182). The strap length adjustment mechanism (182) may be, for example, a knot tied into the harness strap, a clip, etc.

The harness strap includes an earbud interface to connect the harness strap to the harness strap interface of the earbud. The earbud interface on the harness strap for connecting with the earbud and the harness strap may be made of the same or different materials. For example, a metal may be used for the earbud interface on the harness strap while a fabric material is used for the body of the harness strap.

Figure 2B:
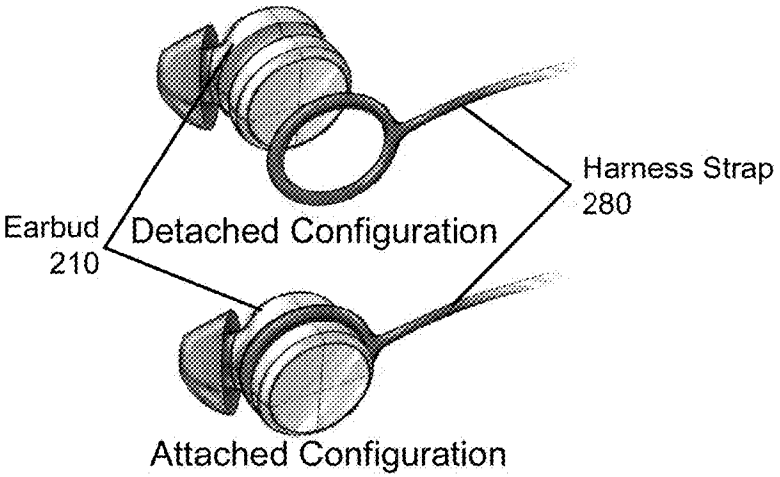
FIGS. 2A, 2B and 2C show headphones, and earbuds and a harness strap of the headphones, in accordance with one or more embodiments.
Figure 2C:
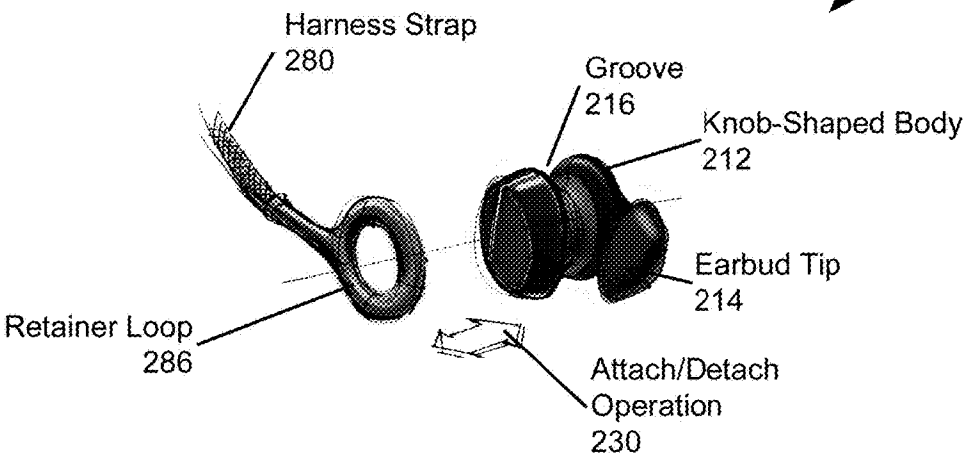
Figure 2A:
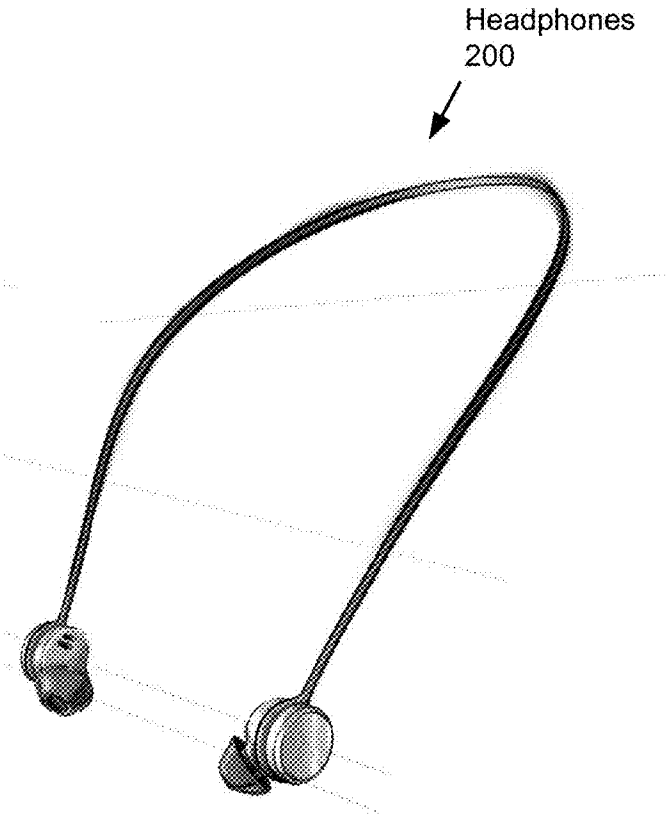

Turning to FIGS. 2A, 2B, and 2C, headphones (200), and earbuds (210) and a harness strap (280) of the headphones in accordance with one embodiment, are shown. The earbuds (210) of the headphones (200) may be worn with or without the harness strap (280). FIG. 2A shows the entire headphones (200), whereas FIGS. 2B and 2C show detail views. FIG. 2B shows a detached configuration and an attached configuration, and FIG. 2C shows additional details including an attached/detach operation (230).

As shown in FIGS. 2A and 2B, the earbud (210) includes a knob-shaped body. While in FIGS. 2A and 2B, the knob-shaped body (212) is substantially cylindrical, in FIG. 2C, the knob-shaped body (212) on one side of the groove (216) has a continuously curved surface, whereas on the other side of the groove (216), the surface resembles a truncated cone.

The knob-shaped body (212) may house various components such as a speaker, a battery, an electronic circuit, a wireless receiver module, etc. The knob-shaped body may be manufactured from any material. A light-weight material such as plastic, an aluminum alloy, carbon-fiber, silicone, epoxy, a composite material, etc., may be used, for example. An earbud tip (214) may extend from the knob-shaped body (212). The earbud tip (214) may be shaped to fit into a listener's ear canal or to otherwise attach to the listener's outer ear.

In one embodiment, a groove (216) in the knob-shaped body (212) circumscribes the knob-shaped body (212) as illustrated in FIG. 2C. The groove (216) forms a harness strap interface configured to hold the detachable harness strap (280).

The harness strap (280), in accordance with an embodiment, terminates in a retainer loop (286) forming an interface to the earbud (210). The retainer loop (286) may be substantially circular. To attach the harness strap (280) to the earbud (210), the retainer loop (286) may be slid over the knob-shaped body (212) to be seated in the groove (216). The retainer loop (286) may be manufactured from an elastic material such as silicone or rubber, allowing the retainer loop (286) to be stretched when attaching or removing the harness strap (280) from the earbud (210). The materials used for the retainer loop (286) and the harness strap (280) may be identical or different. Specifically, while the retainer loop (286) may be manufactured from an elastic material, the harness strap (280) may be manufactured from an elastic or non-elastic material. For example, the harness strap may be made from nylon or any other plastic or fabric material. While FIG. 2C only shows one end of the harness strap (280), a second retainer loop may be attached to the other end of the harness strap thus enabling the harness strap (280) to accommodate two earbuds (210).

The harness strap (280) may be a cord, a wire, a string, a band, etc., linking the two earbuds (210) of the headphones (200). The length of the harness strap (280) may be selected such that the harness strap (280) may comfortably extend across the back of a listener's neck. As previously noted, the length of the harness strap may be adjustable. The harness strap (280) may further be configurable to allow a user to customize materials and/or colors. For example, the retainer loops (286) for a pair of earbuds may be provided, and the user may then choose to pair the retainer loops with the desired harness strap.

Figure 3:
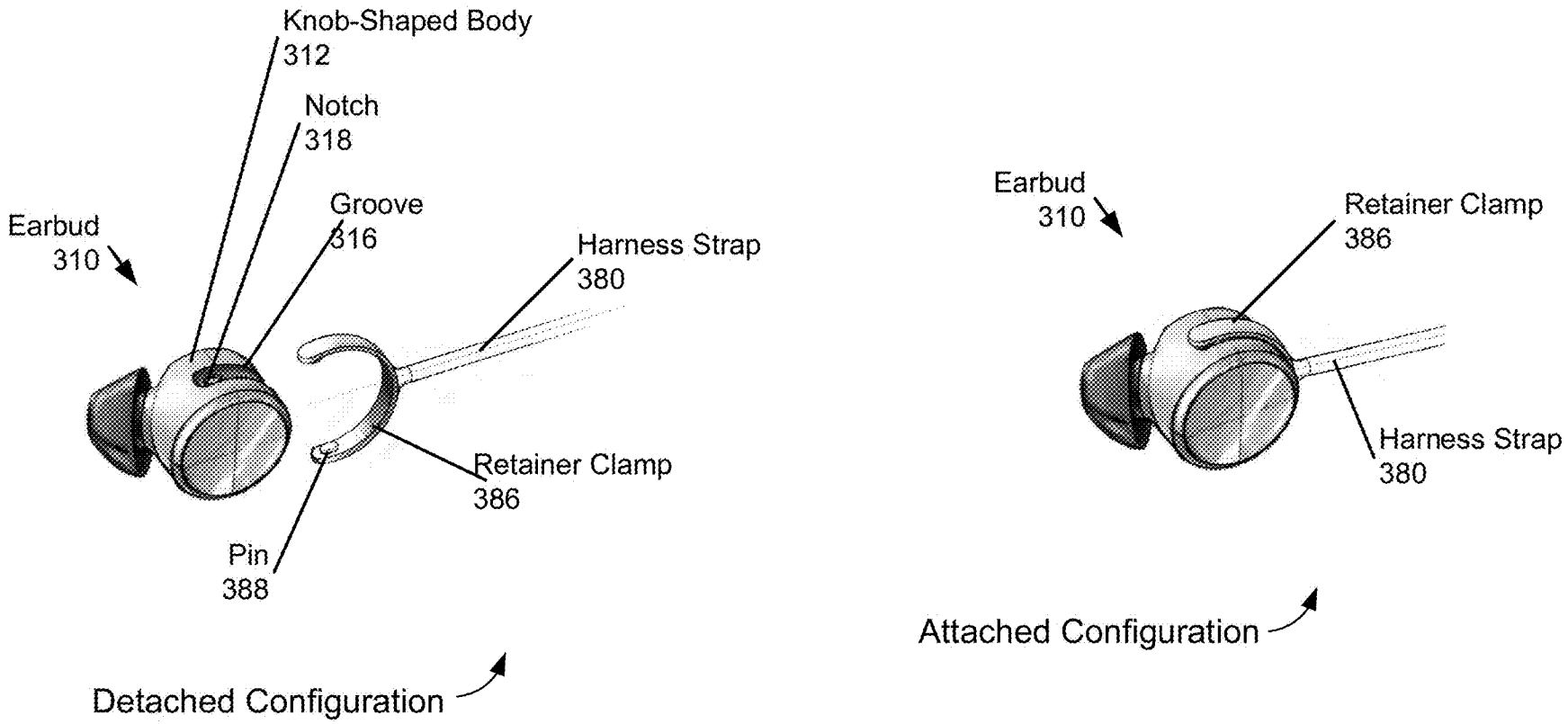
FIG. 3 shows an earbud and a harness strap in accordance with one or more embodiments.

Turning to FIG. 3, an earbud (310) and a harness strap (380), in accordance with one embodiment, are shown. Analogous to the previously discussed headphones, the earbuds (310) may be worn with or without the harness strap (380). The left panel of FIG. 3 shows a detached configuration, and the right panel of FIG. 3 shows an attached configuration.

In the embodiment shown in FIG. 3, the earbud (310) has a knob-shaped body (312) that is substantially cylindrical. The knob-shaped body (312) may be manufactured from the previously discussed materials. The knob-shaped body (312) includes a substantially semi-circular groove (316), configured to accommodate the retainer clamp (386) of the harness strap (380), thus providing a harness strap interface, as described below. While FIG. 3 shows a semi-circular groove (316) that extends to enclose slightly more than 50% of the knob-shaped body (312), other embodiments may enclose a larger or smaller portion of the knob-shaped body without departing from the invention. The semi-circular groove may extend over 40% to 70% of the knob-shaped body, i.e., the groove may describe more or less than a half-circle without departing from the invention.

The harness strap (380), in accordance with an embodiment, terminates in a retainer clamp (386) providing an interface to the earbud (310). The retainer clamp (386) may be C-shaped to match the geometry of the semi-circular groove (316). At each end of the C-shape, the retainer clamp (386) may be equipped with a pin (388) extending perpendicularly from an inner surface of the retainer as illustrated in FIG. 3. When the retainer clamp (386) is pushed into the groove (316), the pin (388) mechanically engages with the notch (318) in the groove (316). A solid but reversible mechanical link may thus be formed. The retainer clamp (386) may be manufactured from a resilient material such as a metal or plastic with spring-like characteristics. The spring-like characteristics is to deform when force is applied, apply a counter force based on a propensity to return to an original shape, and return to the original shape when the force is removed. To attach or detach the retainer clamp, the C-shape may thus widen slightly to snap back to the original shape once the pins (388) have engaged with the notches (318).

The characteristics of the harness strap (380) may be as described with reference to FIGS. 2A, 2B, and 2C. Accordingly, the harness strap may be a cord, a wire, a string, a band, etc.

Figure 4B:
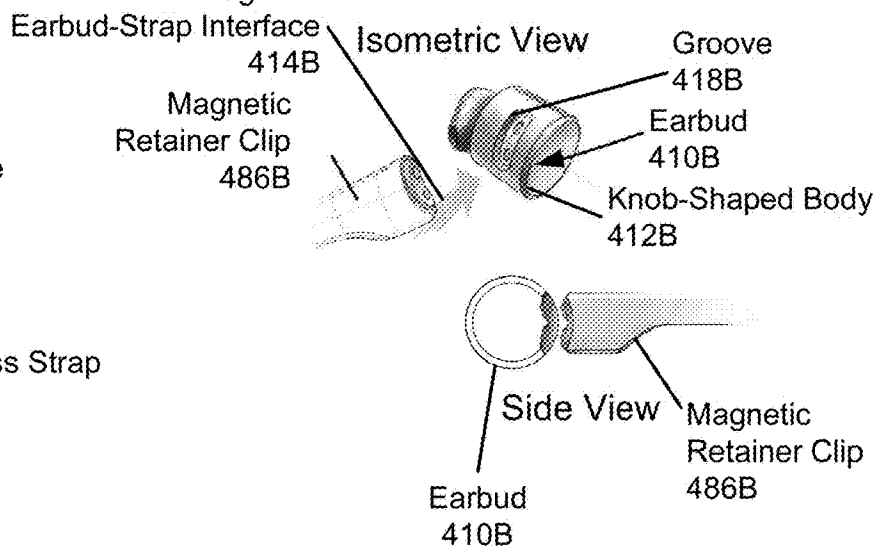
FIGS. 4A and 4B show earbuds and harness straps in accordance with one or more embodiments.
Figure 4A:
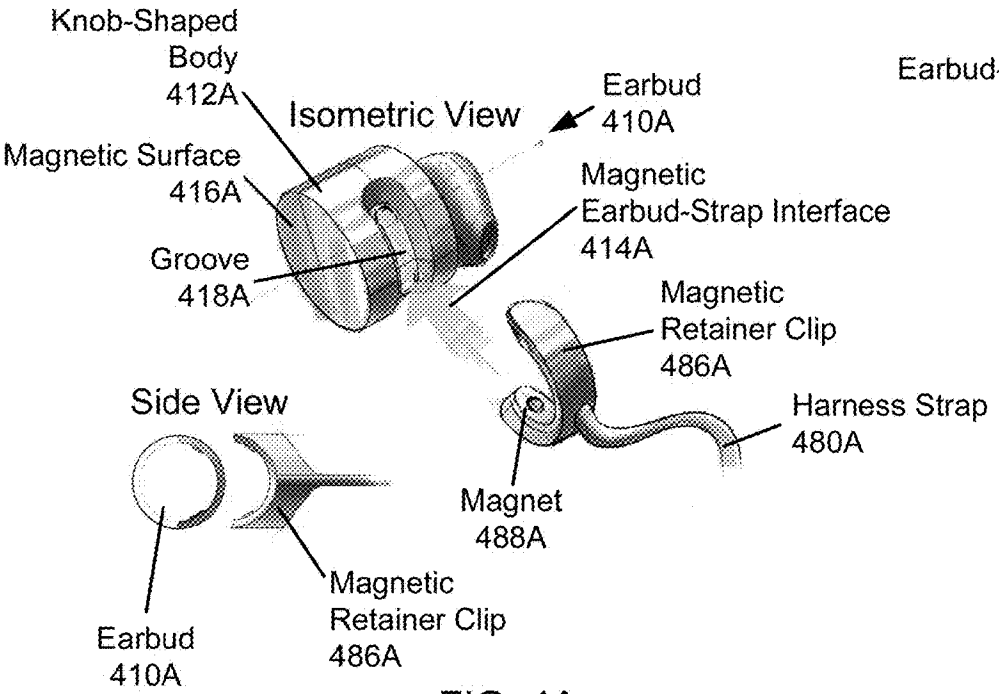

Turning to FIG. 4A, an earbud (410A) and a harness strap (480A), in accordance with one embodiment, are shown. Analogous to the previously discussed headphones, the earbuds (410A) may be worn with or without the harness strap (480A). FIG. 4A includes an isometric view and a side view of the earbud (410A)—harness strap (480A) combination.

In the embodiment shown in FIG. 4A, the earbud (410A) has a knob-shaped body (412A) that is substantially cylindrical. The knob-shaped body (412A) may be manufactured from the previously discussed materials. The knob-shaped body (412A) may have a magnetic surface (416A) that may consist of or may include a ferromagnetic metal. Further, a groove (418A) in the knob-shaped body (412A), configured to accommodate a retainer clip (486A), in combination with the magnetic surface (416A) of the harness strap (480A), may provide a harness strap interface, as subsequently discussed.

The harness strap (480A), in accordance with an embodiment, terminates in a retainer clip (486A) forming an interface to the earbud (410A). In one embodiment, the retainer clip (486A) is magnetic. The retainer clip (486A) may include one or more magnets (488A) that may interact with the magnetic surface (416A) of the knob-shaped body (412A). Alternatively. the magnets may be placed on the knob-shaped body (412A) itself. The retainer clip (486A) may be manufactured from a metal or plastic. To attach the retainer clip (486A), the retainer clip may be aligned with the groove (418A). Magnetic forces by the magnet (488A), pulling the magnetic retainer clip (486A) toward the knob-shaped body (412A) may then establish the magnetic earbud-strap interface (414A). The characteristics of the harness strap (480A) may be as described with reference to FIGS. 2A, 2B, and 2C. Accordingly, the harness strap may be a cord, a wire, a string, a band, etc.

Turning to FIG. 4B, an earbud (410B) and a harness strap (480B), in accordance with one embodiment, are shown.

The configuration illustrated in FIG. 4B includes a magnetic earbud-strap interface (414B) similar to the configuration shown in FIG. 4A. However, the geometry of the retainer clip (486B) and the groove (418B) differ from the geometry of the retainer clip (486A) and the groove (418A). Specifically, while the retainer clip (486A) is shaped like a C-clamp with a substantially semi-circular opening enclosing a relatively wide section of the knob-shaped body (412A), the retainer clip (486B) is in contact with the knob-shaped body (412B) in a considerably narrower region. The grooves (418A, 418B) differ in a similar manner.

Figure 5:
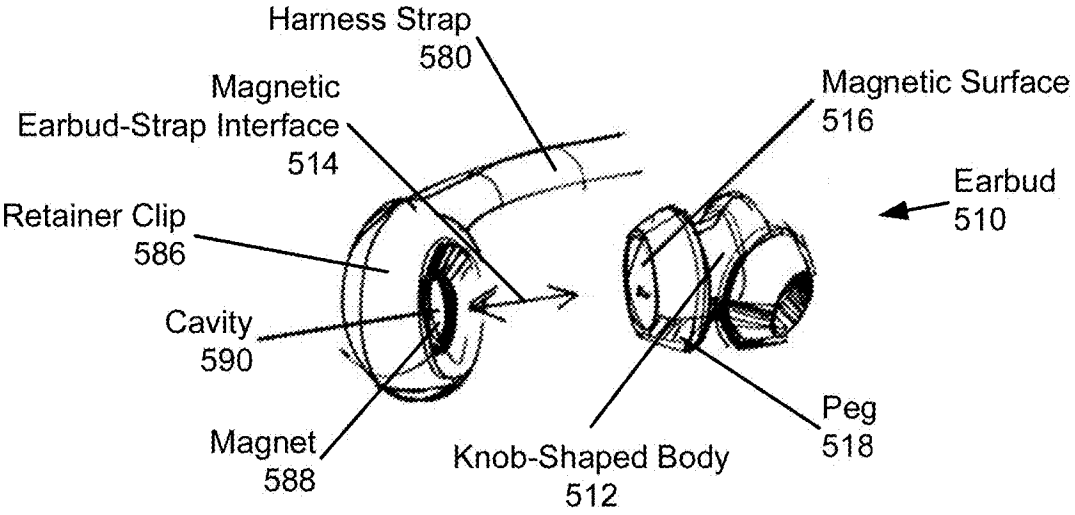
FIG. 5 shows an earbud and a harness strap in accordance with one or more embodiments.

Turning to FIG. 5, an earbud (510) and a harness strap (580), in accordance with one embodiment, are shown. Analogous to the previously discussed headphones, the earbuds (510) may be worn with or without the harness strap (580).

In the embodiment shown in FIG. 5, the earbud (510) has a knob-shaped body (512). The knob-shaped body (512) may have a magnetic surface (516) which may consist of or may include a ferromagnetic metal. The knob-shaped body (512) may further includes a peg (518). The peg (518) may have the shape of a truncated cone. The knob-shaped body (512) may be manufactured from any of the previously discussed materials. The magnetic surface (516) in combination with the peg (518) may provide a harness strap interface.

The harness strap (580), in accordance with an embodiment, terminates in a retainer clip (586) forming an interface to the earbud (510). In one embodiment, the retainer clip (586) is magnetic. The retainer clip (586) may include one or more magnets (588) that may interact with the magnetic surface (516) of the knob-shaped body (512). Alternatively, the magnets may be placed on the knob-shaped body (512) itself. The magnet (588) may provide a magnetic earbud-strap interface (514) when interacting with the magnetic surface (516). The retainer clip (586) may be manufactured from metal or plastic. The retainer clip (586) may be equipped with a cavity (588) that matches the geometry of the peg (518). To attach the retainer clip (586), the cavity (590) of the retainer clip (586) may be aligned with the peg (518). Magnetic forces by the magnet (588), pulling the retainer clip (586) toward the knob-shaped body (512) may then establish the magnetic earbud-strap interface (514). The characteristics of the harness strap (580) may be as described with reference to FIGS. 2A, 2B, and 2C. Accordingly, the harness strap may be a cord, a wire, a string, a band, etc.

Figure 6B:
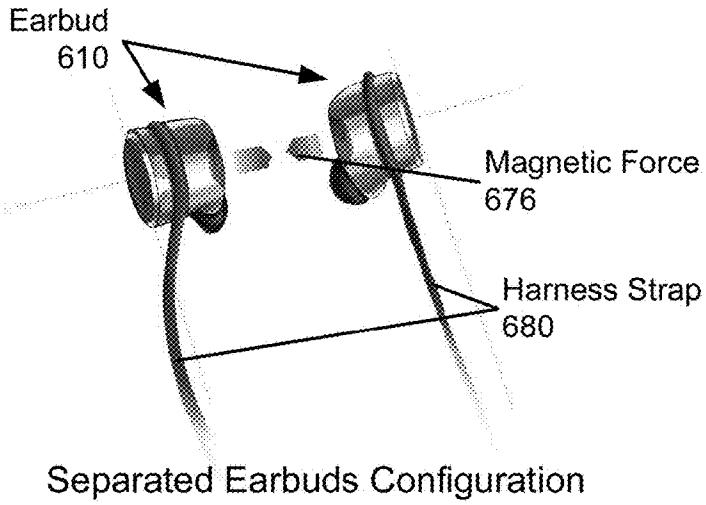
FIGS. 6A and 6B show earbuds in accordance with one or more embodiments.
Figure 6B:
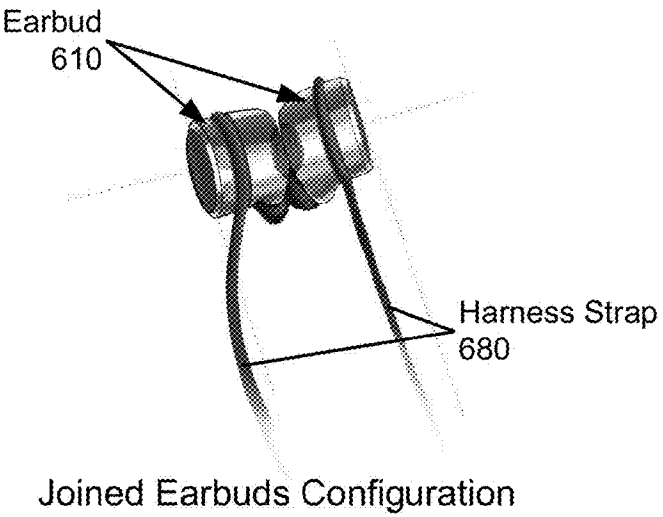
Figure 6A:
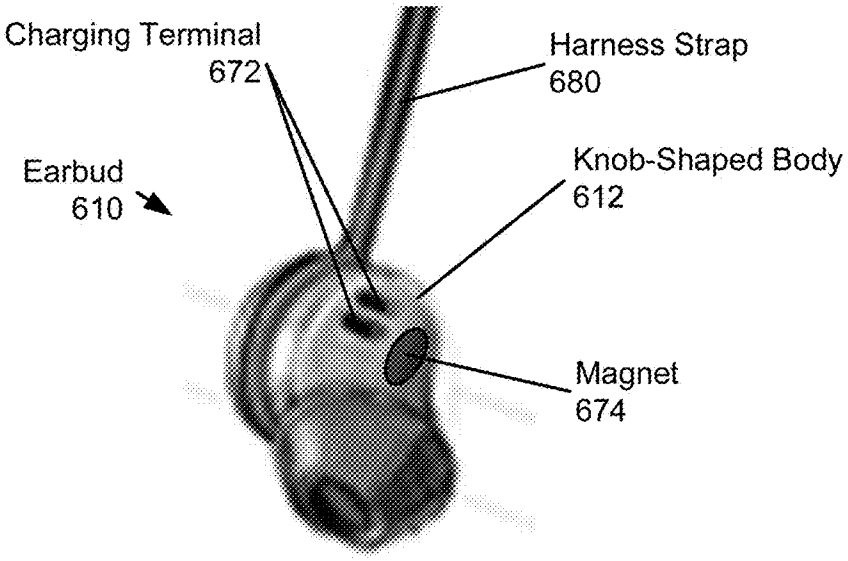

Turning to FIGS. 6A and 6B, earbuds, in accordance with one or more embodiments, are shown. FIG. 6A shows a single earbud (610), equipped with a magnet (674). The earbud (610) may be similar to any of the designs previously discussed with reference to FIGS. 2A, 2B, 2C, 3, 4A, 4B, and 5. The magnet (674) may be embedded in the knob-shaped body (612) of the earbud (610). In the embodiments of FIGS. 4A, 4B, and 5, the magnet (612) may be the magnet used for the magnetic earbud-strap interface (414A, 414B, 514). As illustrated in FIG. 6B, the magnet (674) may be used to clip a pair of earbuds together, thus reducing the risk of loss, and allowing storage of the earbuds with the harness strap (680) wrapped around the neck, similar to a necklace. FIG. 6B shows a pair of earbuds (610) with an attached harness strap (680) in two different configurations: A separated earbuds configuration is shown in the top panel of FIG. 6B, and a joined earbuds configuration is shown in the bottom panel of FIG. 6B. In the separated earbuds configuration, the magnet (674), shown in FIG. 6A, produces a magnetic force (676) pulling the earbuds (610) towards each other. In the joined earbuds configuration, the earbuds (610) are clipped together due to the magnetic force.

In one embodiment, the earbud (610) is further equipped with charging terminals (672) enabling the recharging of a built-in battery. When placed into a charging case (not shown), a magnetic force, generated by the magnet (674), may ensure a good electrical contact to the charging pins in the charging case.

Figure 7:
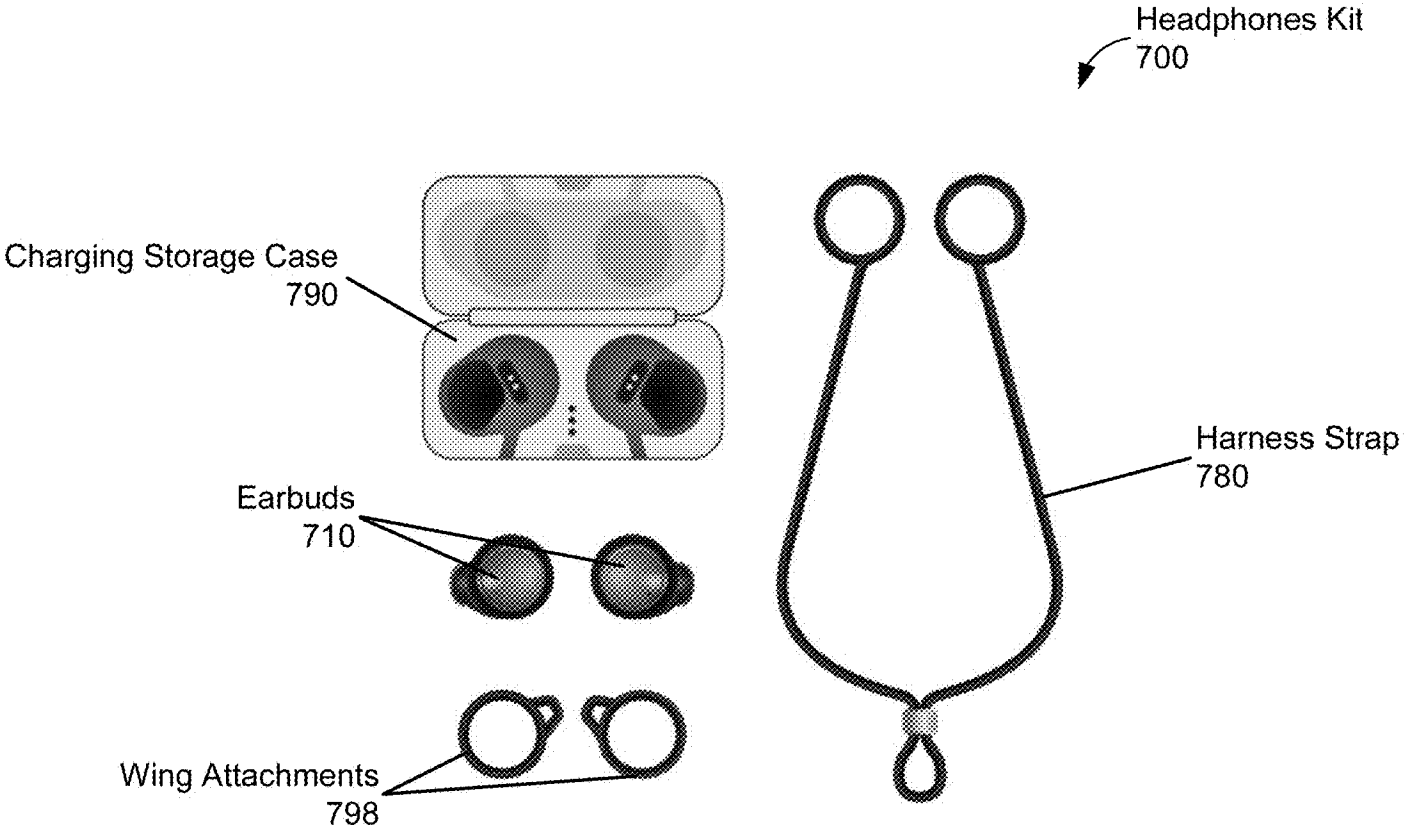
FIG. 7 shows a headphones kit in accordance with one or more embodiments.

FIG. 7 shows an example of a headphones kit (700), in accordance with one or more embodiments. In the example, the headphones kit (700) includes a pair of earbuds (710), a harness strap (780), a charging storage case (790) and wing attachments (798). The earbuds (710) and the harness strap (780) may be substantially similar to the earbuds (210) and the harness strap (280), introduced in FIGS. 2A, 2B, and 2C. A user of the headphones kit (700) may use the earbuds (710) in at least three configurations: (i) the earbuds (710) may be worn without accessories; (ii) the earbuds (710) may be worn with the harness strap (780); and (iii) the earbuds (710) may be worn with the wing attachments (798). The wing attachments (798), mechanically interfacing with the outer ears, may provide additional stability when the earbuds (710) are worn without the harness strap (780). A wing attachment (798) may be accommodated by the groove of an earbud that would otherwise accommodate a retainer loop of a harness strap, as illustrated in FIG. 2.

Further, when not in use, the earbuds may be stored in the charging case with the harness strap attached to the earbuds. The charging case may have grooves for the harness strap. Thus, the charging case may be worn around the users neck when the earbuds are in the case and charging.

One skilled in the art will recognize that the design of earbuds and harness straps is not limited to the examples shown in FIGS. 1, 2A, 2B, 2C, 3, 4A, 4B, 5, 6A and 6B. Specifically, for example, the shape of the earbuds and the harness strap may vary based on aesthetic and functional considerations, without departing from the invention.

While the invention has been described with respect to a limited number of embodiments, those skilled in the art, having benefit of this disclosure, will appreciate that other embodiments can be devised which do not depart from the scope as disclosed herein. Accordingly, the scope should be limited only by the attached claims.

What is claimed is:

1. Headphones comprising:

an earbud comprising:

a knob-shaped body comprising a cylindrical structure;

an earbud tip extending from the knob-shaped body from a wall along a height of the cylindrical structure and in an at least a partially radial direction of the cylindrical structure and configured to enter an ear canal of a listener;

a harness strap interface disposed on the knob-shaped body and configured to removably accommodate a detachable harness strap; and a harness strap comprising at least one elastomeric retainer loop configured to removably retain the earbud by:

stretching around the knob-shaped body, and seating in the harness strap interface.

2. The headphones of claim 1, wherein the harness strap interface comprises a groove fully circumscribing the knob-shaped body, the groove configured to hold a retainer loop of the detachable harness strap.

3. The headphones of claim 2, further comprising a detachable wing attachment configured to removably engage with the groove.

4. The headphones of claim 1, wherein the knob-shaped body comprises one selected from a group consisting of a plastic and a metal surface.

5. The headphones of claim 1, wherein the earbud further comprises charging terminals on the knob-shaped body.

6. The headphones of claim 1, wherein the earbud tip further extends from the knob-shaped body in a direction about perpendicular to a longitudinal axis of the cylindrical structure.

7. A headphones kit comprising:

two earbuds, each of the two earbuds comprising:

a knob-shaped body comprising a cylindrical structure;

an earbud tip extending from the knob-shaped body from a wall along a height of the cylindrical structure and in an at least a partially radial direction of the cylindrical structure and configured to enter an ear canal of a listener;

a harness strap interface disposed on the knob-shaped body and configured to removably accommodate a detachable harness strap; and the detachable harness strap, comprising two elastic retainer loops configured to removably retain the earbud by:

stretching around the knob-shaped body, and seating in the harness strap interface.

8. The headphones kit of claim 7, wherein the harness strap interface comprises a groove fully circumscribing the knob-shaped body, the groove configured to hold a retainer loop of the detachable harness strap.

9. The headphones kit of claim 8, further comprising a detachable wing attachment configured to removably engage with the groove.

10. The headphones kit of claim 7, wherein each of the two earbuds further comprises charging terminals on the knob-shaped body.

* * * * *